US007826595B2

(12) United States Patent
Liu et al.

(10) Patent No.: US 7,826,595 B2
(45) Date of Patent: Nov. 2, 2010

(54) MICRO-FOCUS FIELD EMISSION X-RAY SOURCES AND RELATED METHODS

(75) Inventors: Zejian Liu, Chapel Hill, NC (US); Otto Z. Zhou, Chapel Hill, NC (US); Jianping Lu, Chapel Hill, NC (US)

(73) Assignee: The University of North Carolina, Chapel Hill, NC (US)

( * ) Notice: Subject to any disclaimer, the term of this patent is extended or adjusted under 35 U.S.C. 154(b) by 0 days.

(21) Appl. No.: 11/717,590

(22) Filed: Mar. 13, 2007

(65) Prior Publication Data

US 2008/0043920 A1 Feb. 21, 2008

Related U.S. Application Data

(63) Continuation-in-part of application No. 10/970,384, filed on Oct. 22, 2004, which is a continuation of application No. 10/051,183, filed on Jan. 22, 2002, now Pat. No. 6,876,724, which is a continuation-in-part of application No. 09/679,303, filed on Oct. 6, 2000, now Pat. No. 6,553,096.

(60) Provisional application No. 60/781,872, filed on Mar. 13, 2006.

(51) Int. Cl.
*H01J 23/04* (2006.01)

(52) U.S. Cl. ..... 378/122; 378/138

(58) Field of Classification Search ..... 378/122, 378/119, 136

See application file for complete search history.

(56) References Cited

U.S. PATENT DOCUMENTS

| | | | | |
|---|---|---|---|---|
| 3,201,631 | A * | 8/1965 | Gale et al. | 313/443 |
| 3,732,426 | A * | 5/1973 | Shimizu | 250/399 |
| 5,748,701 | A * | 5/1998 | Mika et al. | 378/109 |
| 6,333,968 | B1 * | 12/2001 | Whitlock et al. | 378/136 |
| 6,456,691 | B2 * | 9/2002 | Takahashi et al. | 378/122 |
| 6,778,633 | B1 * | 8/2004 | Loxley et al. | 378/113 |
| 2003/0198318 | A1 * | 10/2003 | Price et al. | 378/122 |

* cited by examiner

*Primary Examiner*—Hoon Song
(74) *Attorney, Agent, or Firm*—Jenkins, Wilson, Taylor & Hunt, P.A.

(57) ABSTRACT

Micro-focus field emission x-ray sources and related methods are provided. A micro-focus field emission x-ray source can include a field emission cathode including a film with a layer of electron field emitting materials patterned on a conducting surface. Further, the x-ray source can include a gate electrode for extracting field emitted electrons from the cathode when a bias electrical field is applied between the gate electrode and the cathode. The x-ray source can also include an anode. Further, the x-ray source can include an electrostatic focusing unit between the gate electrode and anode. The electrostatic focusing unit can include multiple focusing electrodes that are electrically separated from each other. Each of the electrodes can have an independently adjustable electrical potential. A controller can be configured to adjust at least one of the electrical potentials of the focusing electrodes and to adjust a size of the cathode.

18 Claims, 9 Drawing Sheets

MICRO-FOCUS FIELD EMISSION X-RAY SOURCES AND RELATED METHODS

RELATED APPLICATIONS

This application is a continuation-in-part of U.S. patent application Ser. No. 10/970,384, filed Oct. 22, 2004, which is a continuation of U.S. patent application Ser. No. 10/051,183, filed Jan. 22, 2002, now U.S. Pat. No. 6,876,724, which is a continuation-in-part of U.S. patent application Ser. No. 09/679,303, filed Oct. 6, 2000, now U.S. Pat. No. 6,553,096, the entire disclosures of which are incorporated herein by reference in their entireties. Further, the presently disclosed subject matter claims the benefit of U.S. Provisional Patent Application Ser. No. 60/781,872, filed Mar. 13, 2006, the disclosure of which is incorporated herein by reference in its entirety.

GOVERNMENT INTEREST

At least some of the presently disclosed subject matter was made with U.S. Government support under Grant Nos. 4R33EB004204-01 and U54CA119343 awarded by NIH-NIBIB and NIH-NCI, respectively. Thus, the U.S. Government has certain rights in the presently disclosed subject matter.

TECHNICAL FIELD

The subject matter disclosed herein relates generally to x-ray sources. More particularly, the subject matter disclosed herein relates to micro-focus field emission x-ray sources and related methods.

BACKGROUND

X-ray radiation has been widely used in imaging applications such as medical diagnosis, security screening, and industrial inspection. Current x-ray imaging systems typically consist of an x-ray source, an object stage, and a digital detector/film. The spatial resolution of current imaging systems is limited by the size of x-ray focal spot characteristics, detector pixel pitch, and imaging geometries. It is desirable to improve the spatial resolution of current x-ray imaging systems. By reducing the focal spot size in an x-ray imaging system, the spatial resolution of the imaging system can be increased.

High-resolution x-ray micro computed tomography (micro-CT) is now routinely used for in vivo imaging in preclinical cancer studies of small animals with high spatial and contrast resolution. Its capability for in vivo imaging of lung and colon cancers in mouse models has recently been demonstrated. By using contrast medium, micro-CT is effective in revealing soft tissues.

A typical micro-CT scanner comprises a microfocus x-ray source, a sample stage, and a flat panel x-ray detector. The resolution of the scanner is determined by parameters including the x-ray focal spot size (i.e., the size of the anode area that emits x-ray radiation), the geometry, and the detector resolution. Although x-ray sources with an effective focal spot size of less than 10 μm are now commercially available, in practice the imaging resolution is constrained by motion-induced blur in live objects and by concerns of the total x-ray dose, especially for longitudinal studies. For ungated micro-CT imaging of live mice, prior experiments have shown that the imaging artifacts due to respiratory and cardiac motions may completely obscure the anatomical details within the region of the lung and heart. Motion-induced artifacts can be reduced by gating the x-ray exposure in synchronization with physiological signals. A recent study using a respiratory and cardiac gated micro-CT with a conventional thermionic x-ray source reported spatial resolution of ~100 μm. Further increasing the resolution is partially limited by the temporal resolution and available flux of the x-ray source.

Carbon nanotubes (CNTs) possess extraordinary physical and chemical properties. They have been demonstrated as excellent electron field emitters due to their high geometric aspect ratio, high mechanical strength, and chemical stability. They have been employed as efficient electron field emission cathodes in the development of x-ray sources. Diagnostic quality x-ray radiation with temporal resolution up to a microsecond has been successfully demonstrated.

Carbon nanotube based field emission x-ray sources have been shown to have several intrinsic advantages over the current x-ray tubes with thermionic cathodes. These include high temporal resolution and capabilities for spatial and temporal modulation. In addition, the ease of electronic control of the radiation readily enables synchronized and/or gated imaging which is attractive for imaging of live objects. However, known experiments have demonstrated a deficiency in achieving fine or small focal spots in x-ray sources. Therefore, it is desirable to provide field emission x-ray sources having very fine or small focal spots. Such field emission x-ray sources can provide improved resolution for obtaining more detailed images of objects, particularly small objects.

SUMMARY

In accordance with this disclosure, novel micro-focus field emission x-ray sources and related methods are provided.

It is an object of the present disclosure therefore to provide novel micro-focus field emission x-ray sources and related methods. This and other objects as may become apparent from the present disclosure are achieved, at least in whole or in part, by the subject matter described herein.

BRIEF DESCRIPTION OF THE DRAWINGS

The subject matter described herein will now be explained with reference to the accompanying drawings of which.

DETAILED DESCRIPTION

Figure 1A:
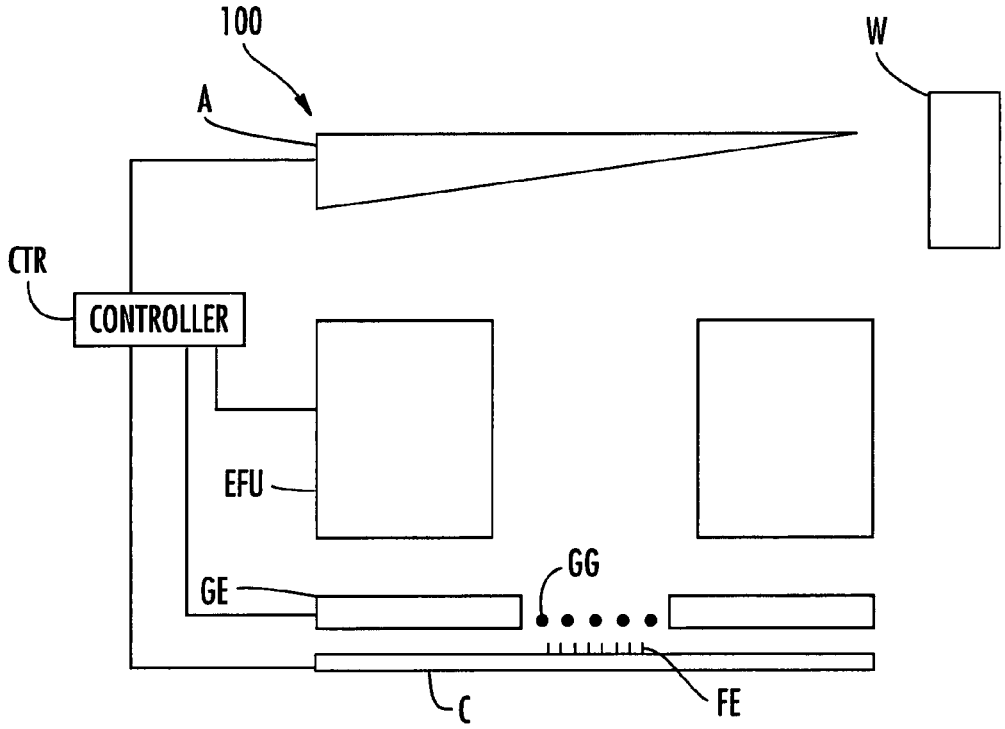
FIG. 1A is a schematic, cross-sectional side view of exemplary components inside a vacuum envelope of the micro-focus field emission x-ray source according to an embodiment of the subject matter described herein.

In accordance with the present disclosure, micro-focus field emission x-ray sources and related methods are provided. The x-ray sources and related methods described herein can have particular application for use in imaging small objects as described herein. A micro-focus field emission x-ray source according to the present disclosure can include a field emission cathode comprising a film with a layer of electron field emitting materials patterned on a conducting surface. Further, the x-ray source can include a gate electrode for extracting field emitted electrons from the cathode when a bias electrical field is applied between the gate electrode and the cathode. The x-ray source can also include an anode. Further, the x-ray source can include an electrostatic focusing unit between the gate electrode and anode, where the unit comprises multiple focusing electrodes that are electrically separated from each other. Each of the electrodes can have an independently adjustable electrical potential. A controller can be configured to adjust at least one of the electrical potentials of the focusing electrodes and to adjust a size of the cathode for setting an x-ray focal spot size of the emitted electrons on the anode. The adjustment can be based on a predetermined relation of the size of the cathode, a value of at least one of the electrical potentials, and the x-ray focal spot size.

Micro-focus field emission x-ray sources in accordance with the subject matter described herein can generate a micro-focal spot that is comparable to or superior to conventional x-ray sources. Experimental measurements have shown that a stable effective isotropic focal spot size of less than 30 μm can be obtained using an x-ray source in accordance with the subject matter described herein. Further, the emission current and x-ray flux are stable at the energy (20-100 keV (peak)) used for small animal imaging. Voltage applied to the electrostatic focusing unit can be controllable to reduce a focal spot area on the anode by a factor of about 4 to about 100 compared with an area of the field emission cathode. In one embodiment, a focal spot area generated by the emitted electrons on the anode can be about 50 micrometers in diameter or less.

For cone-beam tomography imaging systems, it is desirable to have an x-ray source with isotropic focal spot. In reflection-based x-ray generation systems, circular electron emission cathode can produce elliptically-shaped x-ray focal spots. Thus, in x-ray sources with isotropic resolution, it is desirable to provide an elliptical cathode for generating an isotropic effective focal spot in projection with an appropriate take-off angle. As described herein, an elliptical cathode is obtained by depositing carbon nanotubes onto a predetermined area on a suitable conducting substrate, such as in an at least substantially elliptical shape. The elliptical shape can be adjusted based on the take-off angle of the x-ray anode, thereby obtaining an isotropic effective x-ray focal spot.

Figure 1B:
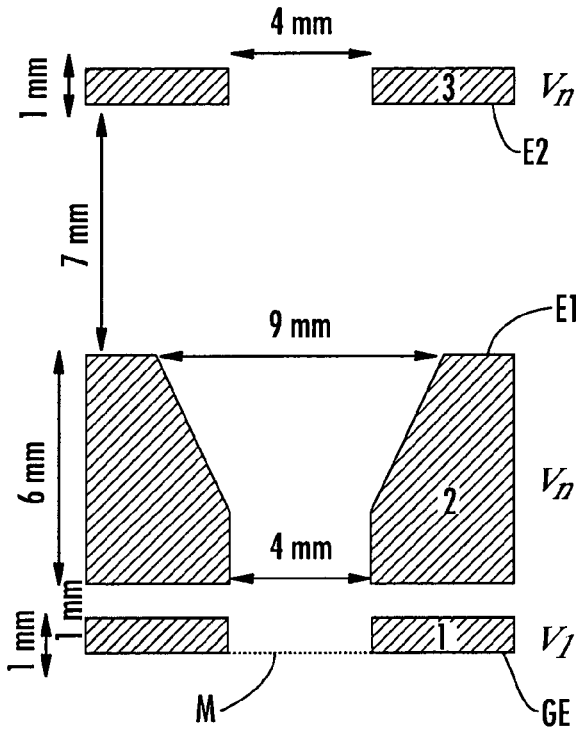
FIG. 1B is a schematic, cross-sectional side view of more details of electrostatic focusing unit shown in FIG. 1A according to an embodiment of the subject matter described herein.

FIGS. 1A and 1B illustrate views of a micro-focus field emission x-ray source according to one embodiment of the subject matter described herein. FIG. 1A is a schematic, cross-sectional side view of exemplary components inside a vacuum envelope of the micro-focus field emission x-ray source generally designated 100. X-ray source 100 can include a field emission cathode C, a gate electrode GE, an electrostatic focusing unit EFU, and an anode A. Field emission cathode substrate C can include a plurality of electron field emitters FE. Referring to FIG. 1A, electron field emitters FE can comprise one or more carbon nanotubes and/or other suitable electron field emission materials. Electron field emitters FE can be attached to a surface of a cathode, conductive or contact line, or other suitable conductive material. The cathodes can be attached to a suitable non-conductive substrate such that the electron field emitters are electrically isolated.

Electron field emitters FE can be controlled (i.e., turned on and off) to emit electrons for selectively bombarding a focal spot of anode A for producing x-ray radiation. In one embodiment, a controller CTR can control a voltage source VS to individually apply voltages between each electron field emitter FE and a gate electrode GE to generate electric fields for extracting electrons from electron field emitters FE. Controller CTR can include hardware, software, and/or firmware, such as memory (e.g., RAM, ROM, and computer-readable disks), transistors, capacitors, resistors, inductors, logic circuitry, and other components suitable for controlling electron emission from electron field emitters FE. Controller CTR can also control the intensity, timing, and duration of electron emission for electron field emitters FE.

Controller CTR can execute instructions for performing a sequence by which electron field emitters FE to emit electrons to cause anode A to emit x-ray radiation for imaging an object. The executable instructions can be implemented as a computer program product embodied in a computer readable medium. Exemplary computer readable media can include disk memory devices, chip memory devices, application specific integrated circuits, programmable logic devices, downloadable electrical signals, and/or any other suitable computer readable media.

X-ray source 100 can be housed in a vacuum chamber at $1\times10^{-7}$ Torr base pressure or any other suitable pressure. Field emitted electrons can be extracted from cathode substrate C by application of a bias voltage on gate electrode GE by controller CTR. Electrostatic focusing unit EFU can focus the emitted electrodes before they reach anode A. The emitted electrons are focused to a very fine or small focal spot size.

Anode A can be positioned to intercept the emitted electrons to thereby generate x-ray radiation. The x-ray radiation can be directed toward an x-ray window W configured to allow the x-ray radiation to pass through the vacuum chamber. In one embodiment, referred to as the reflection geometry, the x-ray window can be angled with respect to the electron beam of emitted electrons such that the generated x-ray radiation radiates in a direction at least substantially perpendicular the electron beam. In another embodiment, referred to as the transmitted geometry, anode A and the x-ray window W can comprise of a single thin metal structure such that its surface is facing the cathode and the structure is substantially x-ray transparent, wherein the generated x-ray radiation radiates primary in the direction of the electron beam.

Field emission cathode substrate C can include a film with one or several layers of electron emitting materials patterned on a substrate. In one process, field emitters FE can be attached to cathode substrate C by first undergoing a purification and oxidation treatment and then being deposited onto a conducting substrate, which acts as a cathode. Electrons can be extracted from field emitters FE by application of a voltage between gate electrode GE and cathode substrate C for generation of an electric field. The emitting cathode can be operable in a pulse mode with a peak electron beam current from 0.1 μA to 10 mA or more for micro-focus x-ray source. Alternatively, the emitting cathode can be operable in a pulse mode with a peak electron beam current from 0.1-10 mA.

As described in more detail hereinbelow, field emitters FE can be deposited on the substrate of cathode substrate C to form one of several different patterns, such as one of a circular shape, a triangular shape, an elliptical shape, a washer shape, a square shape, and a rectangular shape. In one example, cathode can be in an at least substantially circular or elliptical shape to provide an isotropic effective x-ray focus spot. The cathode substrate C can be any suitable conductive structure and can have a sharp tip or protrusion for electron emission under an electrical field. Field emitters FE can be one or more of suitable field emission materials including carbon nanotubes, "Spindt" tips, and suitable nanoparticles.

Carbon nanotubes readily emit large fluxes of electrons. A carbon nanotube can be a single-wall carbon nanotube, few-wall carbon nanotubes, or multi-wall carbon nanotube. Carbon nanotubes, nanowires and nanorods can be fabricated by techniques such as laser ablation, arc discharge, and chemical vapor deposition (CVD) methods. Further, carbon nanotubes can be made via solution or electrochemical synthesis. An exemplary process for fabricating carbon nanotubes is described in the publication "Materials Science of Carbon Nanotubes: Fabrication, Integration, and Properties of Macroscopic Structures of Carbon Nanotubes," Zhou et al., *Acc. Chem. Res.,* 35: 1045-1053 (2002), the disclosure of which is incorporated herein by reference. A single carbon nanotube or a nanotube bundle can produce a current of about 0.1-10 μA.

Exemplary electron field emitters can include "Spindt" tips and other suitable nanostructures. "Spindt" tips and related processes are described in the publication "Vacuum Microelectronics," I. Brodie and C. A. Spindt, *Advances in Electronics and Electron Physics,* 83: 1-106 (1992), the disclosure of which is incorporated by reference herein. Exemplary materials of electron field emitter tips can include molybdenum (Mo), silicon (Si), diamond (e.g., defective CVD diamond, amorphous diamond, cesium-coated diamond, a nanodiamond), and graphite powders.

Nanostructures suitable for electron emission can include nanotube and nanowires/nanorods composed of either single or multiple elements, such as carbon nanotubes. A single carbon nanotube can have a diameter in the range of about 0.5-500 nm and a length on the order of about 0.1-100 microns.

Gate electrode GE can be electrically connected to a tungsten gating grid GG. The gate can also be a structure fabricated by etching of Si or by micro-machining of metal such as laser cutting of tungsten. Gate electrode GE can also function to focus the electrons emitted from field emitters FE. Gating grid GG can include fine bars and be mounted above cathode substrate C. Electrons can be extracted out of field emitters FE by the electric field between gate electrode GE and cathode substrate C.

Anode A can be made of metallic materials which provides desirable x-ray spectrum. Choice of the anode materials can include but not limited to, copper, molybdenum, silver, and tungsten. The anode tilting angle can range from 6 degree to 45 degree. It can be arranged in either the reflection mode or the transmission mode.

A controller can be configured to adjust at least one of the electrical potentials of focusing electrodes and to adjust a size of the cathode for setting an x-ray focal spot size of emitted electrons on an anode based on a predetermined relation of the size of the cathode, the electrical potentials, and the x-ray focal spot size. For example, controller CTR can be configured to adjust the potential applied to electrodes E1, E2, and GE for setting an x-ray focal spot size of emitted electrons on anode A based on a predetermined relation of the electrical potentials and the focal spot size. In another example, controller CTR can be configured to adjust a size of cathode field emitters FE for setting an x-ray focal spot size of emitted electrons on anode A based on a predetermined relation of the size of cathode field emitters FE and the focal spot size. In another example, controller CTR can be configured to adjust the potential applied to electrodes E1, E2, and GE and to adjust a size of cathode field emitters FE for setting an x-ray focal spot size of emitted electrons on anode A based on a predetermined relation of the size of cathode field emitters FE, the focal spot size, and the electrical potentials. An example of controlling the size of the cathode is described in further detail below.

FIG. 1B is a schematic, cross-sectional side view of more details of electrostatic focusing unit EFU shown in FIG. 1A according to an embodiment of the subject matter described herein. Referring to FIG. 1B, electrostatic focusing unit EFU can be positioned between cathode substrate C and anode A. Further, electrostatic focusing unit EFU can include three parallel focusing electrodes GE, E1, and E2 that are electrically separated from each other by insulating spacers. Electrodes GE and E2 can be made of planar metal diaphragms. Central focusing electrode E1 can be in the shape of a truncated cone, which functions to harness the divergence of electrons coming out of gating grid GG, and thereby prefocuses the electrons into more parallel shape before they reach focusing electrode E2. Electrodes E1 and E2 function to focus the field-emitted electrons into an appropriate probe that impinges the facing surface of anode A. In one embodiment, Einzel-type lenses may be used. Simulation results have indicated that asymmetrical Einzel-type lenses with a middle conical electrode with a cone angle of $2\tan^{-1}(1/2)$ have a small spherical aberration in focusing electrons.

Electrostatic focusing unit EFU is described in this embodiment having three parallel electrodes that are electrically separated from each other. Alternatively, an electrostatic focusing unit in accordance with the subject matter described herein can include more than three parallel electrodes. Further, the electrodes of the electrostatic focusing unit can be of any shape suitable for focusing field-emitted electrons. Further, electrostatic focusing unit EFU can be configured to adjust a focal spot area generated by the emitted electrons on anode A by changing x-ray tube current and maintaining electrical potentials of the focusing electrodes during the change of the x-ray tube current. The focal spot area generated by the emitted electrons on anode A can be stable in size and position over a predetermined period of time.

The apertures of electrodes GE, E1, and E2 can be about 4 mm in diameter, although any other suitable dimension may be used. Results based on electron optics simulations have shown that the focusing system shown in FIG. 1B is very linear in focusing electrons emitted from cathodes with a diameter ranging between about 0.1 mm and about 2 mm. For instance, electrons emitted from circular cathodes of 0.2 mm and 0.5 mm in diameter would be focused on the anode with a diameter of 34 μm and 83 μm, respectively. The linearity of the electrostatic focusing unit as described herein provides very good flexibility in varying the size and geometry of field emitter FE to generate the desired x-ray focal spot.

Controller CTR can independently adjust the voltage potentials between electrodes GE, E1, and E2. In one embodiment, gate electrode GE is placed at the same voltage potential as gating grid GG. Further, electrodes GE, E1, and E2 can have independently controllable potentials. Any potential may be selected for suitably focusing the field-emitted electrons. In particular, the potentials may be adjusted to different values and to different potentials with respect to one another for achieving a desirable x-ray focal spot, such as an x-ray focal spot having a suitable dimension and/or size.

Figure 2A:
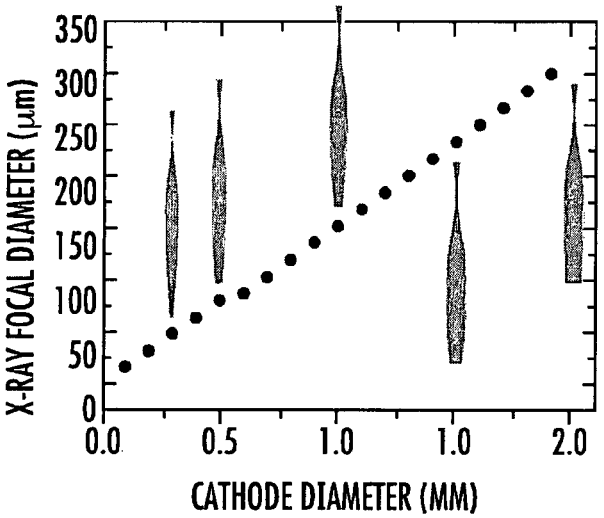
FIG. 2A is a graph of electron optics simulation results demonstrating the linearity and magnification of the electrostatic focusing unit using a modified asymmetrical Einzel lenses.
Figure 2B:
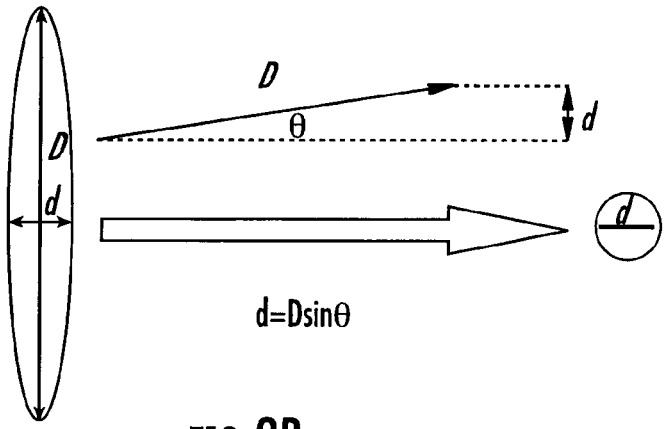
FIG. 2B is a schematic diagram of the formation of an isotropic effective focal spot on the projected plane with the anode take-off angle of θ.

Simulations were performed based on electrostatic focusing unit EFU shown in FIG. 1B. FIGS. 2A and 2B show the relation between the cathode diameter and the focal diameter of the electron beam on the anode obtained from the simulation. Referring to FIG. 2A, a graph is illustrated of electron optics simulation results demonstrating the linearity and magnification of the electrostatic focusing unit using a modified asymmetrical Einzel lenses. The result indicates that the focusing system illustrated in FIG. 1 is linear for cathodes with a diameter ranging between about 0.1 and 2 mm. Simulation results showed that a demagnification of about 6 was achieved in the x-ray source design shown in FIGS. 1A and 1B. The linearity provides very good flexibility in designing the size and geometry of the field emitter FE for obtaining isotropic effective x-ray focal spot. FIG. 2B is a schematic diagram illustrating the formation of an isotropic effective focal spot on the projected plane with the anode take-off angle of θ.

Figure 2C:
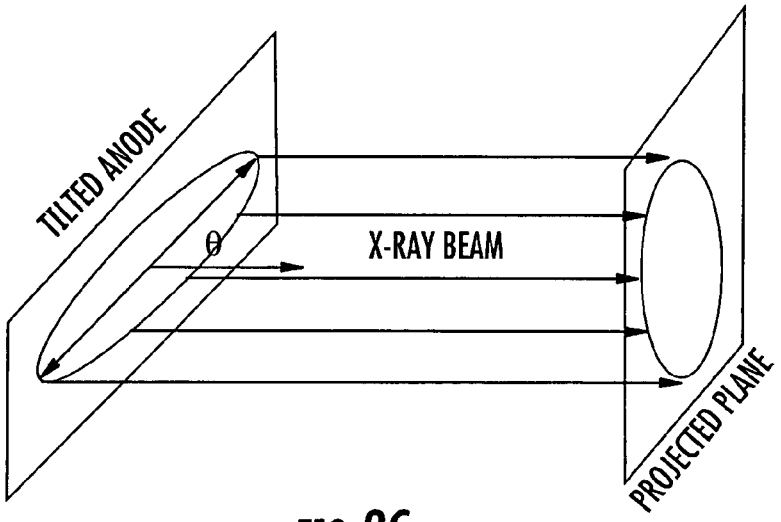
FIG. 2C is a schematic diagram of a tilted anode and projected plane configuration showing use of an elliptical shaped CNT cathode to achieve an isotropic effective focal spot size.

In one experiment, measurements were obtained using a testing station as shown in FIGS. 1A and 1B. X-ray source 100 can be housed in a vacuum at $1\times10^{-7}$ Torr base pressure. Field emission electrons were extracted from cathode substrate C by applying a bias voltage on gate electrode GE and were subsequently focused by electrodes E1 and E2 before reaching anode A. An elliptical shaped CNT cathode was used to achieve an isotropic effective focal spot size as schematically shown in FIG. 2C. The minor length of the elliptical probe forms the true focal spot size, while the major length is projected to be equal to the true focal spot size by adjusting the take-off angle θ on the tilted anode.

Figure 3A:
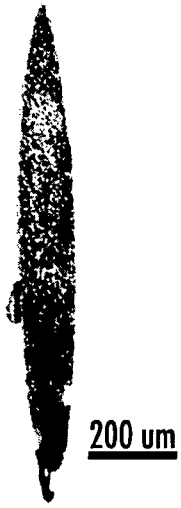
FIG. 3A is an optical image of an elliptical carbon nanotube cathode according to an embodiment of the subject matter described herein.

In another experiment, measurements were obtained using an x-ray source as shown in FIGS. 1A and 1B. An elliptical shaped carbon nanotube cathode was used to achieve an isotropic effective focal spot size as shown in FIG. 2B. The cathode was formed by selective deposition of a uniform layer of CNT film onto highly doped silicon substrate using a combined electrophoresis and photolithography process. FIG. 3A is an optical image of an elliptical carbon nanotube cathode according to an embodiment of the subject matter described herein. The cathode was formed by combined lithography and electrophoresis deposition techniques. The cathode has a major length and a minor length of 1.0 and 0.15 mm, respectively. Further, for example, the cathode can be elliptically-shaped and have a major length between about 0.1 millimeter and 2 millimeters. The electron field emission characteristics of the carbon nanotube cathode were measured using triode geometry (such as with the x-ray source shown in FIG. 1A) in a dynamical vacuum of $1\times10^{-7}$ Torr base pressure. With the cathode grounded, the anode potential was set at 40 kV.

Figure 3B:
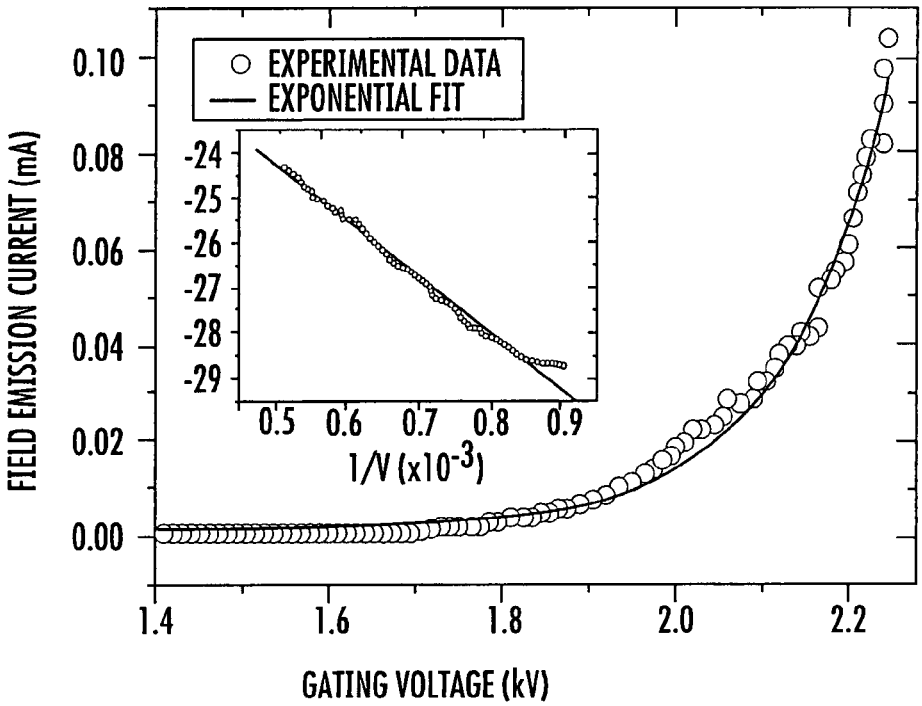
FIG. 3B is a graph of the field emission current-voltage curve of the cathode shown in FIG. 3A.

FIG. 3B is a graph illustrating the field emission current-voltage curve of the cathode shown in FIG. 3A. The graph shows that the emission current-voltage curve under a continuous mode fits suitably to the classic Fowler-Nordheim equation of electron field emission. The cathode current density of ~100 mA/cm$^2$ was obtained at a gate electric field of 12 V/μm. The transmission rate of the gating grid was about 85% in this measurement. Higher current density can be achieved with increased gate potential.

Figure 3C:
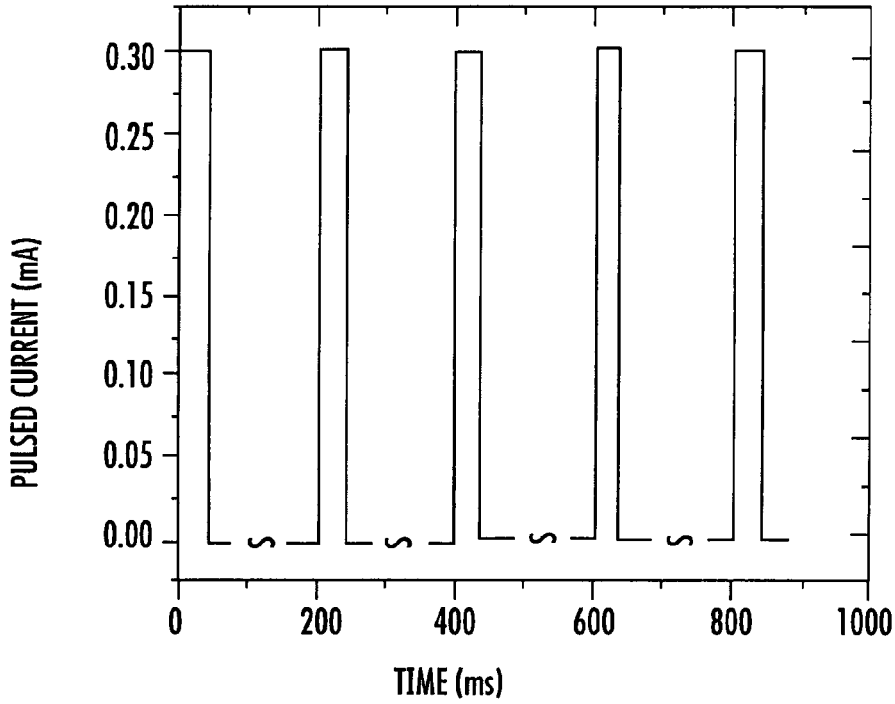
FIG. 3C is a graph of field emission current operated in the pulsed mode with the frequency and duty cycle of 100 Hz and 2%, respectively, of the cathode shown in FIG. 3A.

The cathode shown in FIG. 3A was also tested in the pulsed mode. FIG. 3C is a graph illustrating the field emission current operated in the pulsed mode with the frequency and duty cycle of 100 Hz and 2%, respectively.

Figure 3D:
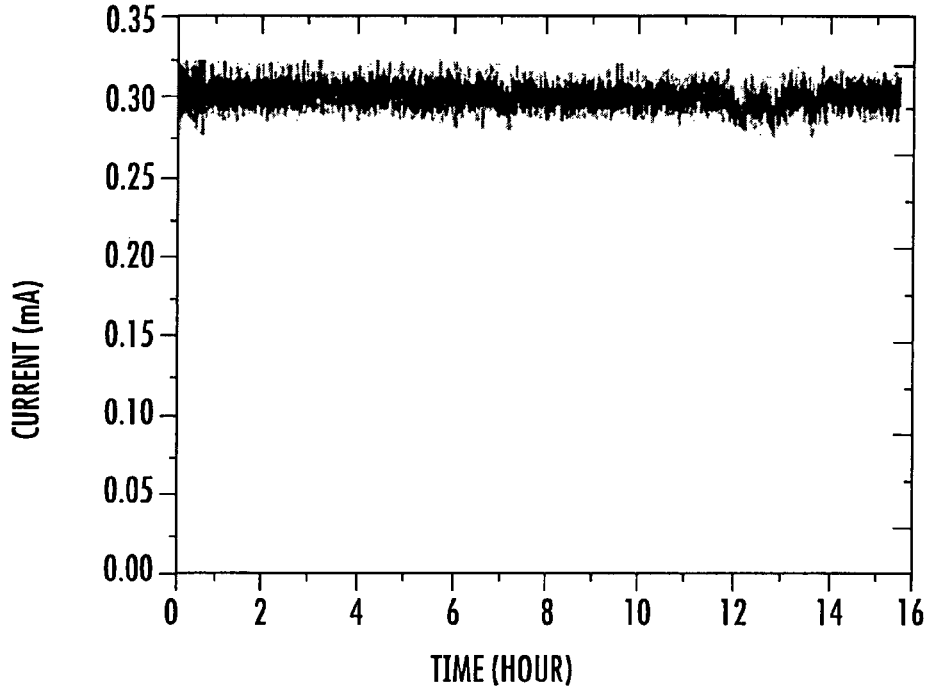
FIG. 3D is a graph of current versus time in the pulsed mode with the frequency and duty cycle of 100 Hz and 2%, respectively, of the cathode shown in FIG. 3A.

FIG. 3D is a graph illustrating current versus time in the pulsed mode with the frequency and duty cycle of 100 Hz and 2%, respectively. Referring to FIG. 3D, a stable peak emission current of 0.3 mA was obtained with negligible degradation during the observation period of 15 hours. It is expected that the cathode could reach higher current than 0.5 mA.

Figure 4A:
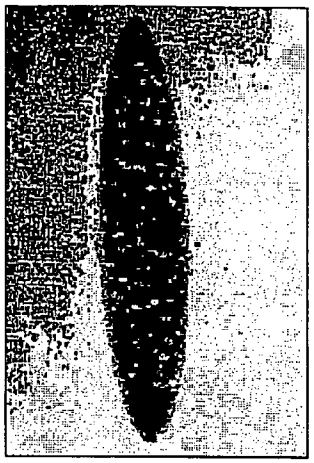
FIG. 4A is an optical image of another elliptical carbon nanotube cathode according to an embodiment of the subject matter described herein.
Figure 4B:
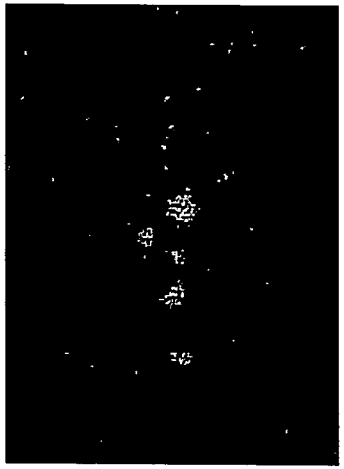
FIGS. 4B-4F are images of the field emission patterns of the elliptical cathode shown in FIG. 4A at different gate voltages.
Figure 4C:
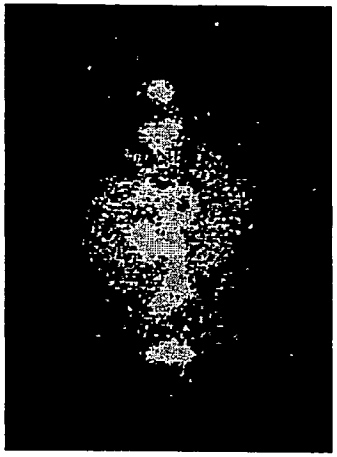
Figure 4D:
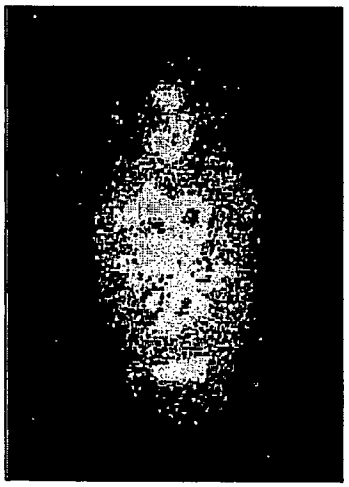
Figure 4E:
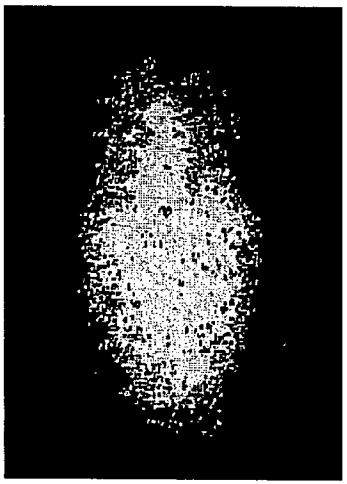
Figure 4F:
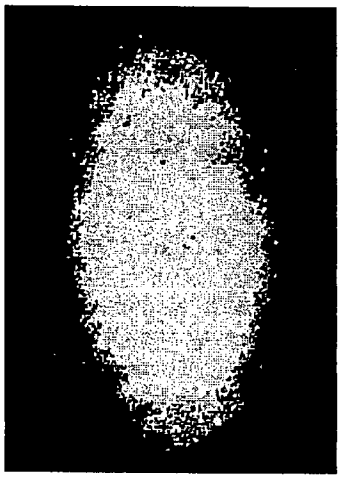

FIG. 4A is an optical image of another elliptical carbon nanotube cathode according to an embodiment of the subject matter described herein. A phosphor screen was used as the anode to record the field emission pattern at different applied voltages. FIGS. 4B-4F are images of the field emission patterns of the elliptical cathode at different gate voltages.

Figure 5:
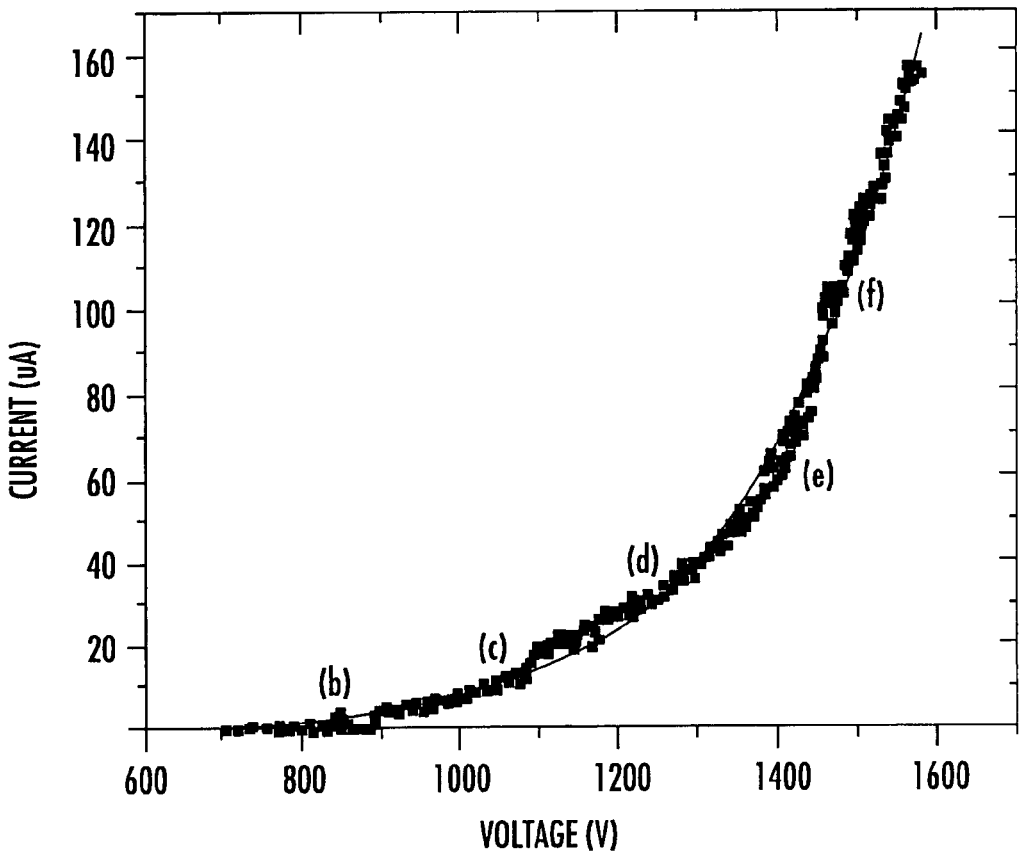
FIG. 5 is a graph of a current-voltage curve of the cathode shown in FIG. 4, indicating the exponential increment of the field-emitted current with respect to the gate voltages.

FIG. 5 is a graph illustrating a current-voltage curve of the cathode shown in FIG. 4 indicating the exponential increment of the field-emitted current with respect to the gate voltages.

Figure 6:
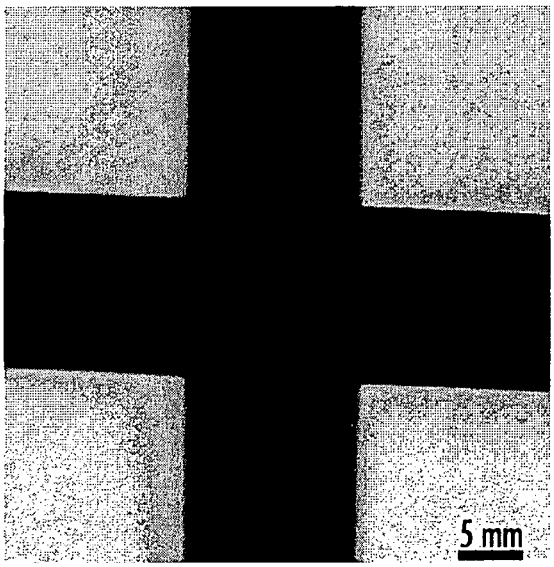
FIG. 6 is an x-ray projection image of a tungsten bar phantom generated by an x-ray source in accordance with the subject matter described herein.

An x-ray imaging scanner with the micro-focus z-ray sources accordance with the subject matter described herein was set up to measure the focus spot size. A flat panel sensor with 50×50 μm$^2$ pixel size were used. FIG. 6 is an x-ray projection image of a tungsten bar phantom generated by an x-ray source in accordance with the subject matter described herein and used for analyzing the focus spot size. Following the European standard EN 12543-5, the x-ray focal spot was determined to be 30 μm in both directions.

Figure 7:
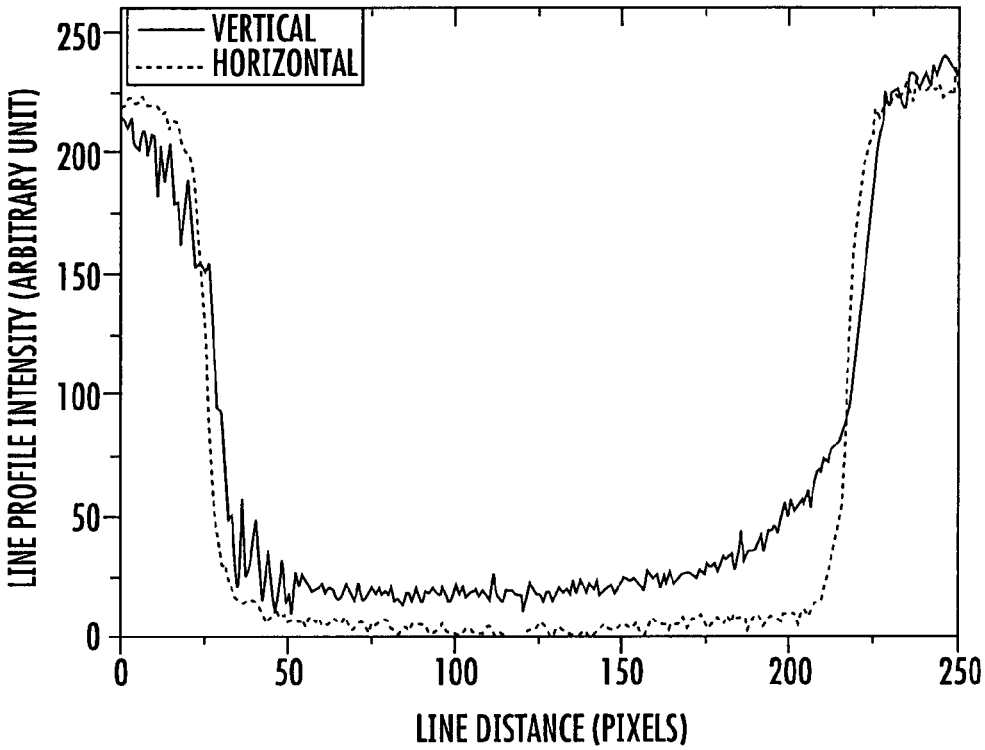
FIG. 7 is a graph of line intensity profiles crossing the horizontal and vertical tungsten bars shown in FIG. 6.

FIG. 7 is a graph of line intensity profiles crossing the horizontal and vertical tungsten bars shown in FIG. 6. The phantom was magnified by about 1.85. The diameter of the x-ray focal spot was calculated to be 30±5 μm from the line intensity profiles of the cross bars shown in FIG. 7. The focal spot demagnification factor is about 5, which is calculated from the ratio of the cathode size (about 150 μm) and the true focal spot diameter (about 30 μm). No change in the focal spot size was observed during the course of the imaging experiments (about 20 hours).

Figure 8:
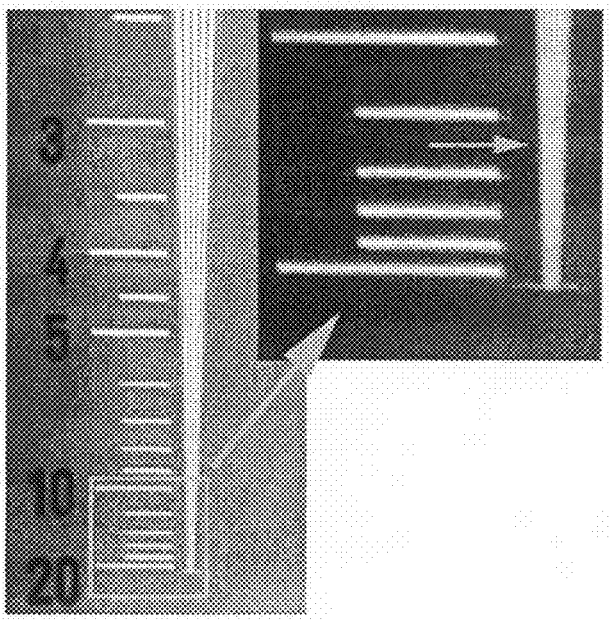
FIG. 8 is an x-ray projection image of a line pair resolution phantom generated by an x-ray source in accordance with the subject matter described herein.

The resolution of this isotropic x-ray source was further demonstrated by imaging a line pair resolution phantom. As shown in FIG. 8, line pairs/mm of up to 13 was clearly resolved. FIG. 8 is an x-ray projection image of a line pair resolution phantom generated by an x-ray source in accordance with the subject matter described herein.

Figure 9:
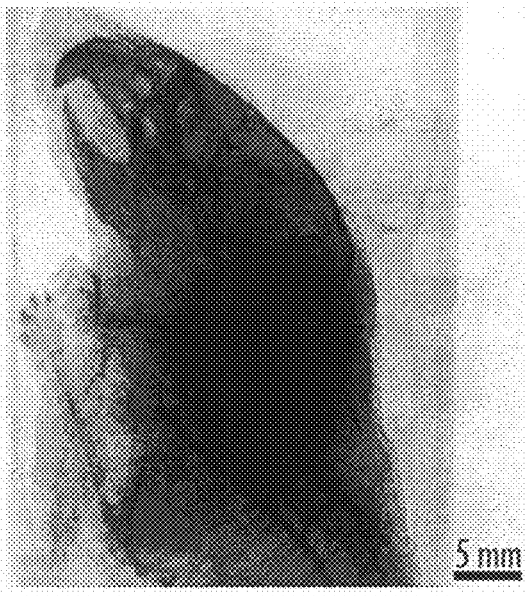
FIG. 9 is an x-ray projection image of a mouse injected with barium contrast-enhancement agent generated by an x-ray source in accordance with the subject matter described herein.

FIG. 9 is an x-ray projection image of a mouse injected with barium contrast-enhancement agent generated by an x-ray source in accordance with the subject matter described herein. The anode voltage was set at 40 kV (peak) with an exposure of 0.1 mA s. The source to object and source to detector distances were set at 20 and 32 cm, respectively, which results in a geometrical magnification of 1.6 for mouse imaging. The aorta of the mouse's heart is clearly shown.

In one embodiment, a plurality of x-ray sources in accordance with the subject matter described herein can be arranged together in a multi-pixel formation. One example includes forming a plurality of x-ray sources 100 shown in FIG. 1A into a multi-pixel arrangement. The x-ray sources can be controlled by a single controller for programmably controlling the individual actuation of the pixels. In one example, the x-ray sources can include a plurality of field emission cathodes each comprising a film with a layer of electron field emitting materials patterned on a conducting surface. A plurality of gate electrodes can each be operable to extract field emitted electrons from a respective one of the cathodes when a bias electrical field applied between the gate electrode and the respective one of the cathodes is larger than a critical value. An anode can be positioned opposite the cathode for intercepting extracted field emitted electrons from the cathode. Further, a plurality of electrostatic focusing units can each be positioned between a respective one of the gate electrodes and the anode. Each unit can comprise multiple focusing electrodes that are electrically separated from each other. Further, each of the electrodes can have an independently adjustable electrical potential. A controller can be configured to selectively activate the x-ray source pixels for imaging an object.

In one example of a multi-pixel arrangement of x-ray sources, a cathode can comprise multiple and electrically-isolated carbon nanotube emitter structures patterned on a substrate. In this example, each emitter structure can be activated independently.

In one embodiment, a first predetermined portion of the carbon nanotube emitter structures and a second predetermined portion of the carbon nanotube emitter structures can be activated to produce focal spots of different sizes on the anode. By use of such a structure, a device in accordance with the subject matter described herein can be operated over a wide range of current and focal spot size. Further, the controller can be configured to adjust a size of a cathode in this way for setting an x-ray focal spot size of the emitted electrons on the anode based on a predetermined relation of the size of the cathode and a value of one or more of the electrical potentials and/or the x-ray focal spot size.

Figure 10A:
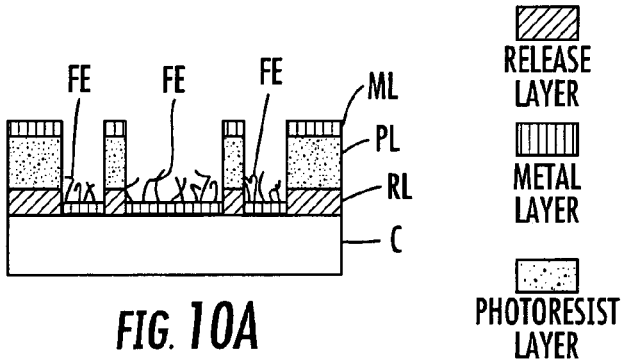
FIGS. 10A-10C are different view of a layer of electron field emitting materials patterned having first and second portions according to an embodiment of the subject matter described herein.
Figure 10B:
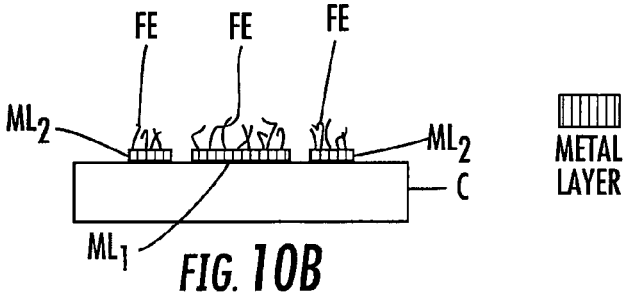
Figure 10C:
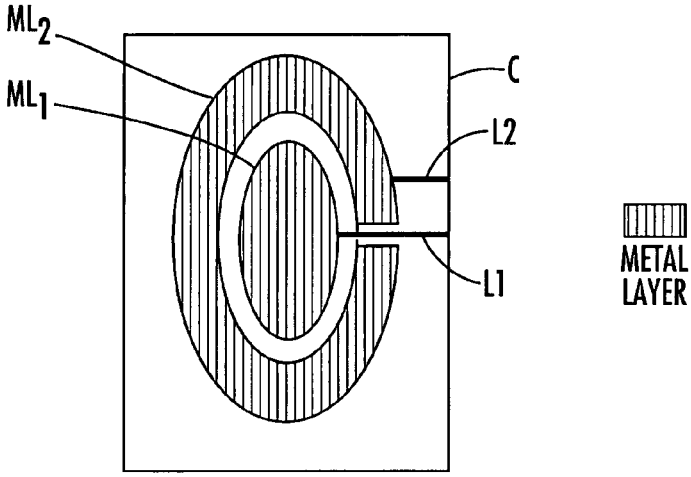

FIGS. 10A-10C are different view of a layer of electron field emitting materials patterned having first and second portions according to an embodiment of the subject matter described herein. The different portions can be controllably activated to produce focal spots of different sizes on the anode. Referring to FIG. 10A, a cross-section side view of a step in the fabrication of electron field emitting materials patterned on a cathode substrate C is illustrated. Electron field emitters FE can be attached to portions of a metal layer ML. In particular, emitters FE are formed on metal layer's first and second portions ML1 and ML2, as shown in FIG. 10B. During fabrication, a release layer RL, a photoresist layer PL, and metal layer ML can be formed on substrate C. The areas of metal layer's first and second portions ML1 and ML2 are electrically insulated by lithographic EPD process.

FIGS. 10B and 10C are a cross-section side view and a top view, respectively, of the result of the fabrication process described with respect to FIG. 10A. As a result, metal layer portions ML1 and ML2 can be formed on a surface of substrate C. Electrically conductive lines L1 and L2 can be connected to metal layer portions ML1 and ML2, respectively. Metal layer portions ML1 and ML2 can be individually activated for adjusting a size of cathode, or a size of field emitters FE emitting electrons. For example, only center metal layer portion ML1 can be activated to produce a smaller focal spot on an anode for increased resolution and low x-ray flux. Both metal layer portions ML1 and ML2 can be activated for providing a larger focal spot on an anode, thus low resolution and high x-ray flux results. Accordingly, variable x-ray flux and resolutions can be achieved by individually activated metal layer portions ML1 and ML2. Further, metal layer portion ML2 can be activated when a maximum current density of metal layer portion ML2 is reached before a predetermined electron beam current of a device is reached.

A carbon nanotube based micro-focus field emission x-ray source in accordance with the subject matter described herein can provide high spatial resolution, temporal resolution, and stable emission. The flux generated by this source at 30 μm resolution is higher than those used in conventional micro-CT imaging systems with a fixed-anode thermionic x-ray source operating at a comparable resolution where the current is less than 0.1 mA at 40 kV (peak). Focal spot sizes down to 10 μm can be obtained using an x-ray source having a sufficiently small carbon nanotube cathode in accordance with the subject matter described herein. The combined high spatial and temporal resolutions of the carbon nanotube based field emission micro-focus field emission x-ray source are highly attractive for dynamical tomography imaging.

Further, an x-ray source in accordance with the subject matter described herein can be beneficial for high-resolution cone-beam tomography imaging. In combination with the fast gating capability of a carbon nanotube based x-ray source, an isotropic x-ray source can enable dynamical tomography images of live small animals to be obtained with high resolution when operated in a prospective gating mode.

A controller of device or system in accordance with the subject matter described herein can selecting at least one of a structure of the electron field emitting materials, electrical potentials of the focusing electrodes, and an electrical voltage of the gate electrode for producing at least one of predetermined electron beam current and predetermined focal spot size. Further, a controller can increase electrical potential applied to the gate electrode for generating high electron beam current.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A method for generating x-ray radiation from a micro-focus spot with electronically adjustable spot size and x-ray tube current, the method comprising:

providing a device comprising:

a field emission cathode comprising a film with a layer of electron field emitting materials patterned on a conducting surface, wherein the electron field emitting materials comprise first and second portions;

a gate electrode for extracting field emitted electrons from the cathode when a bias electrical field is applied between the gate electrode and the cathode;

an anode; and an electrostatic focusing unit between the gate electrode and the anode, wherein the unit comprises multiple focusing electrodes including a pre-focusing electrode and a focusing electrode that are electrically separated from each other and that are positioned in series between the cathode and the anode, and wherein each of the, electrodes has an independently adjustable electrical potential; and adjusting at least one of the electrical potentials of the focusing electrodes and adjusting a size of the cathode for setting an x-ray focal spot size of the emitted electrons on the anode;

wherein the method comprises activating the second portion of the electron field emitting materials when a maximum current density of the first portion of the electron field emitting materials is reached before a predetermined electron beam current is reached.

2. The method of claim 1 wherein the layer of electron field emitting materials comprises components selected from the group consisting of a nanotube and a nanorod.

3. The method of claim 1 wherein the layer of electron field emitting materials comprise carbon nanotubes.

4. The method of claim 1 wherein the anode is configured in the reflection geometry, and wherein the cathode is at least substantially elliptical in shape to provide an isotropic effective x-ray focus spot.

5. The method of claim 1 wherein the cathode is operable to generate a peak electron beam current of about 0.1-10 mA for a focal spot size of about 20-200 micron in diameter.

6. The method of claim 1 wherein the cathode comprises multiple and electrically-isolated carbon nanotube emitter structures patterned on a substrate, wherein each emitter structure generates a predetermined maximum electron current density, and wherein each emitter structure are selected independently.

7. The method of claim 1 comprising first, second and third focusing electrodes, wherein the first electrode has the same electrical potential as the gate electrode, and wherein the electrical potentials of the second and third electrodes are independently adjustable.

8. The method of claim 1 wherein the electrostatic focusing unit is operable to focus the emitted electrons on an isotropic x-ray focus spot on the anode for generating x-ray radiation.

9. The method of claim 1 wherein the electrostatic focusing unit is operable to reduce the x-ray focal spot size on the anode by a factor of about 10 to about 100 compared with an area of the field emission cathode.

10. The method of claim 1 wherein the focusing unit comprises at least three focusing electrodes with independent and adjustable electrical potentials.

11. The method of claim 10 wherein at least one focusing electrode is at the same electrical potential as the gate electrode.

12. The method of claim 1 wherein an effective focal spot area on the anode is about 50 micrometers in diameter or less.

13. The method of claim 12 wherein the cathode is operable in a pulse mode with a peak electron beam current of about 0.1-10 mA.

14. The method of claim 1 wherein the electrostatic focusing unit is configured to adjust a focal spot area generated by the emitted electrons on the anode by changing the electrical potentials of the focusing electrodes.

15. The method of claim 1 wherein the focal spot size generated by the emitted electrons on the anode is stable in size and position over a predetermined period of time.

16. The method of claim 1 wherein adjusting at least one of the electrical potentials of the focusing electrodes and adjusting a size of the cathode is based on a predetermined relation of the size of the cathode, a value of the at least one of the electrical potentials, and the x-ray focal spot size.

17. The method of claim 1 comprising selecting at least one of a structure of the electron field emitting materials, electrical potentials of the focusing electrodes, and an electrical voltage of the gate electrode for producing at least one of predetermined electron beam current and predetermined focal spot size.

18. The method of claim 1 comprising increasing electrical potential applied to the gate electrode for generating high electron beam current.

* * * * *

UNITED STATES PATENT AND TRADEMARK OFFICE

CERTIFICATE OF CORRECTION

PATENT NO. : 7,826,595 B2
APPLICATION NO. : 11/717590
DATED : November 2, 2010
INVENTOR(S) : Zhou et al.

It is certified that error appears in the above-identified patent and that said Letters Patent is hereby corrected as shown below:

At Column 1, Line 21 under the heading "GOVERNMENT INTEREST"

Please delete the following paragraph:

"At least some of the presently disclosed subject matter was made with U.S. Government support under Grant Nos. 4R33EB004204-01 and U54CA119343 awarded by NIH-NIBIB and NIH-NCI, respectively. Thus, the U.S. Government has certain rights in the presently disclosed subject matter."

And replace it with the following paragraph:

-- This invention was made with government support under Grant Nos. 4 R33 EB004204-01 and U54 CA119343 awarded by The National Institutes of Health-National Institute of Biomedical Imaging and Bioengineering and the National Cancer Institute. The government has certain rights in the invention. --

Signed and Sealed this
Fifteenth Day of May, 2012

David J. Kappos

David J. Kappos
*Director of the United States Patent and Trademark Office*